US005462264A

United States Patent [19]

Delagera

[11] Patent Number: 5,462,264

[45] Date of Patent: Oct. 31, 1995

[54] G-CLAMP

[76] Inventor: Joseph Delagera, 139 W. Ave., Hicksville, N.Y. 11801

[21] Appl. No.: 320,669

[22] Filed: Oct. 11, 1994

[51] Int. Cl.[6] ..... B25B 1/10

[52] U.S. Cl. ..... 269/249

[58] Field of Search ..... 269/249, 166–171.5, 269/45, 88, 257

[56] References Cited

U.S. PATENT DOCUMENTS

| | | | |
|---|---|---|---|
| 2,579,995 | 12/1951 | Atchison | 269/249 |
| 2,588,745 | 3/1952 | McKenzie | 269/167 |
| 2,636,527 | 4/1953 | Schiemann | 269/45 |
| 2,894,283 | 7/1959 | Salisbury | 269/249 |
| 5,131,780 | 7/1992 | Love | 269/249 |

FOREIGN PATENT DOCUMENTS

| | | | |
|---|---|---|---|
| 2516006 | 5/1983 | France | 269/166 |

*Primary Examiner*—Robert C. Watson
*Attorney, Agent, or Firm*—Michael I. Kroll

[57] ABSTRACT

A G-clamp comprising a frame having a fixed jaw at a first end and a sleeve with an internally threaded bore at a second end. An operating screw extends through the internally threaded bore of the sleeve. A moveable jaw is mounted on a first side of the operating screw opposite from the fixed jaw on the frame. A handle is mounted transversely in a sliding manner through a second side of the operating screw, so as to rotate the operating screw. A structure on the fixed jaw is for maintaining the distance between the fixed jaw and the sleeve, while increasing the length of the frame. This will keep the amount of manual turning the same when rotating the operating screw, to move the moveable jaw towards and away from the fixed jaw when clasping hard to reach articles together.

1 Claim, 3 Drawing Sheets

G-CLAMP

BACKGROUND OF THE INVENTION

1. Field of the Invention

The instant invention relates generally to holding tools and more specifically it relates to a G-clamp.

2. Description of the Prior Art

Numerous holding tools have been provided in prior art that are adapted grasp various work items together, so that a person can do different types of tasks. While these units may be suitable for the particular purpose to which they address, they would not be as suitable for the purposes of the present invention as heretofore described.

SUMMARY OF THE INVENTION

A primary object of the present invention is to provide a G-clamp that will overcome the shortcomings of the prior art devices.

Another object is to provide a G-clamp that contains an extension piece on its fixed jaw, so as to increase the length of the throat for clasping hard to reach articles together.

An additional object is to provide a G-clamp in which the frame is square shaped in cross section having flat sides, so that the frame can be placed in different positions upon a flat horizontal surface.

A further object is to provide a G-clamp that is simple and easy to use.

A still further object is to provide a G-clamp that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
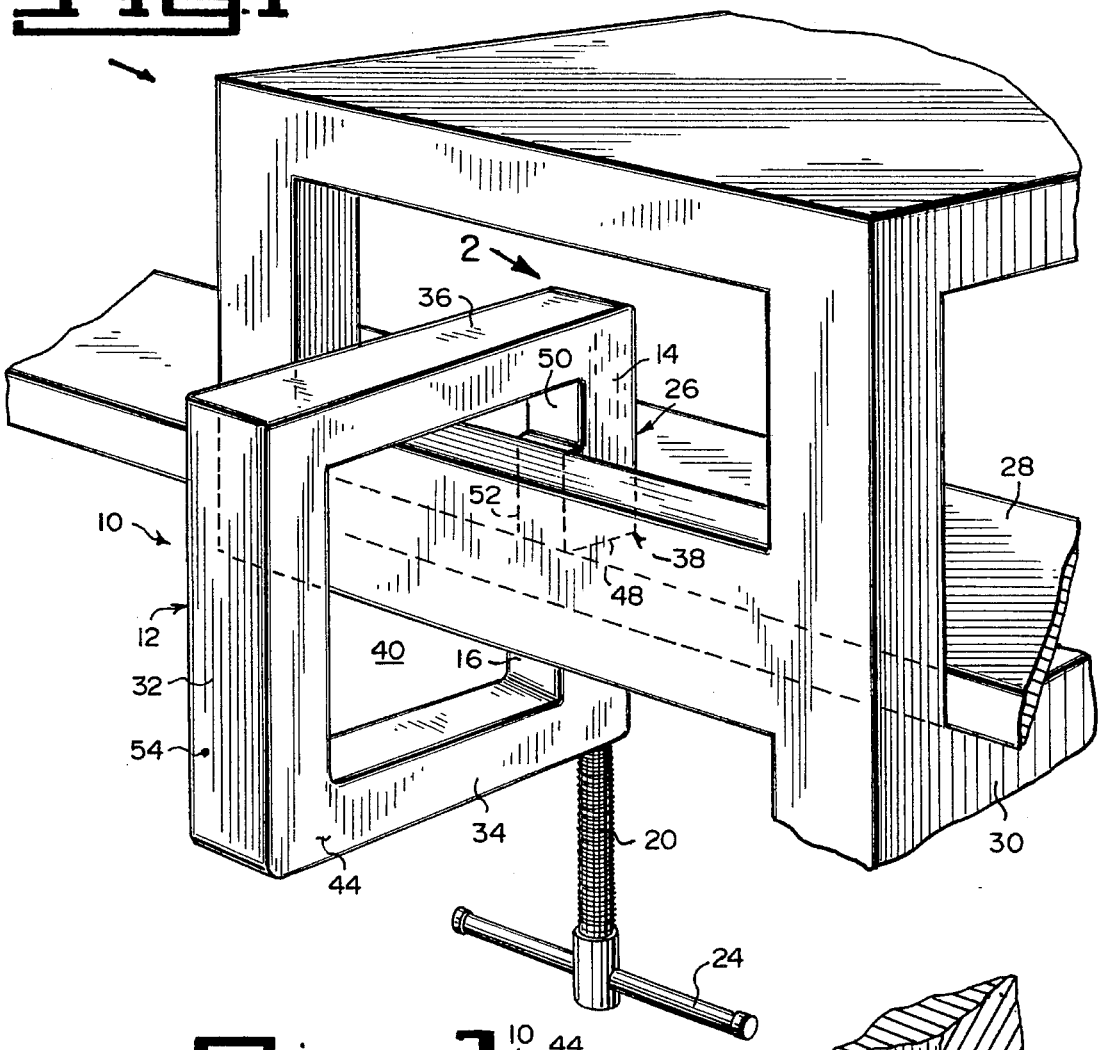
FIG. 1 is a perspective view of the instant invention in use clasping hard to reach articles together.
Figure 2:
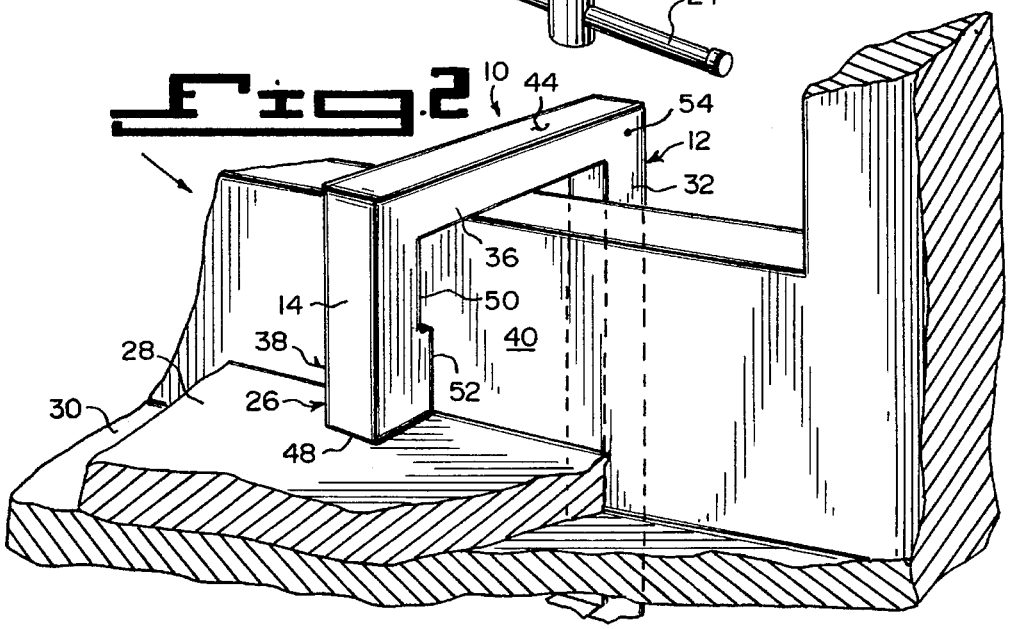
FIG. 2 is a perspective view taken in the direction of arrow 2 in FIG. 1 with parts broken away and in section.
Figure 3:
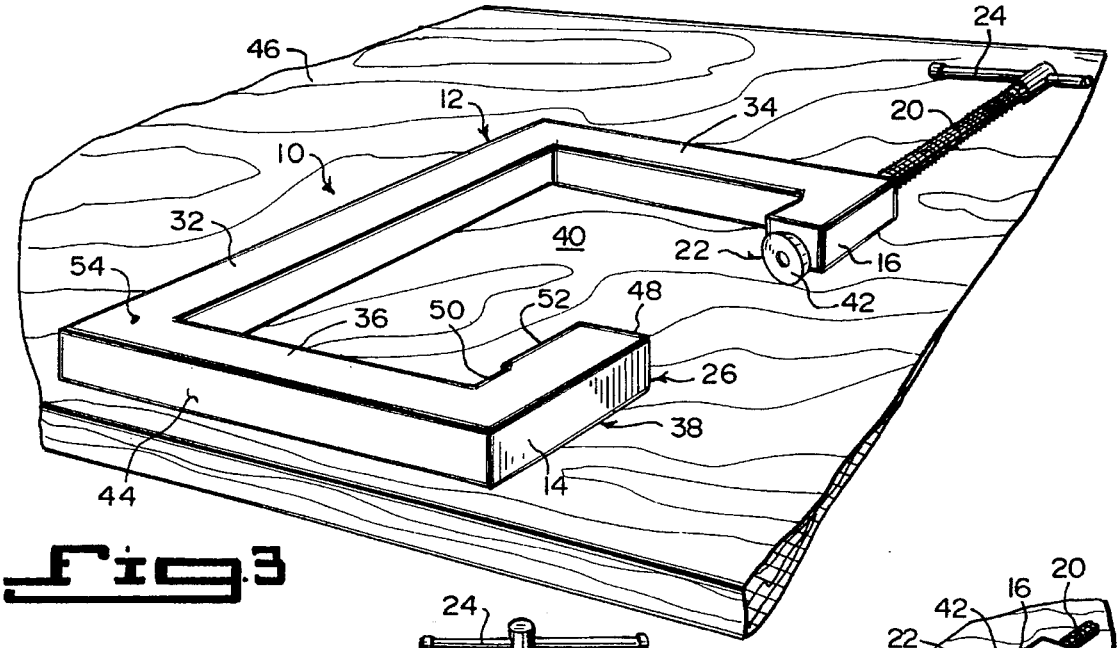
FIG. 3 is a perspective view showing the instant invention lying down on its side upon a flat horizontal surface.
Figure 4:
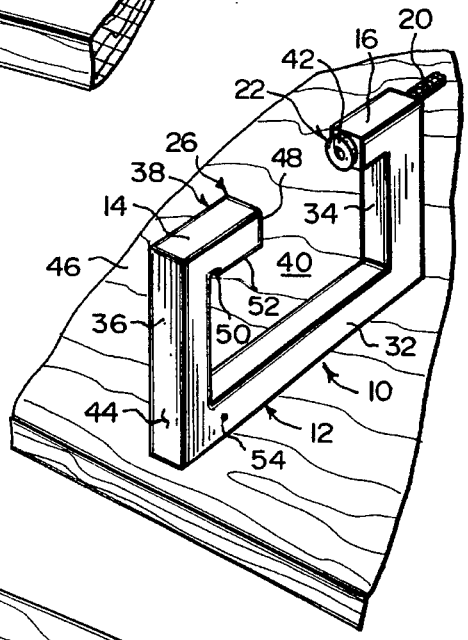
FIG. 4 is a perspective view showing the instant invention standing longitudinally upon the flat horizontal surface.
Figure 5:
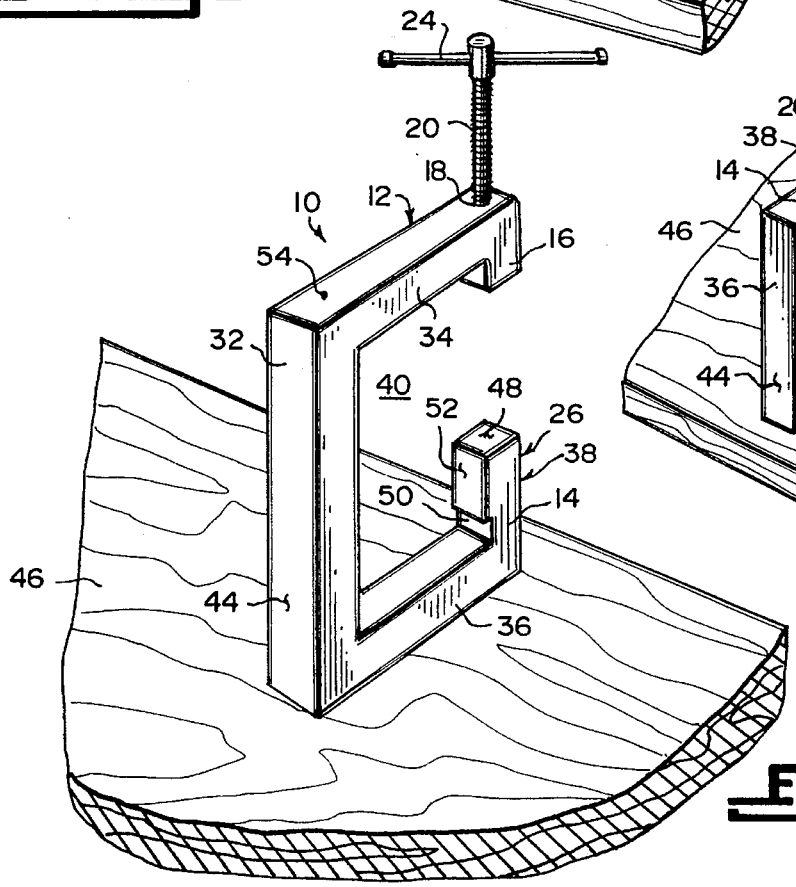
FIG. 5 is a perspective view showing the instant invention standing latitudinally upon the flat horizontal surface.

Turning now descriptively to the drawings, in which similar reference characters denote similar elements throughout the several views, FIGS. 1 through 5 illustrate a G-clamp 10 comprising a frame 12 having a fixed jaw 14 at a first end and a sleeve 16 with an internally threaded bore 18 at a second end. An operating screw 20 extends through the internally threaded bore 18 of the sleeve 16. A moveable jaw 22 is mounted on a first side of the operating screw 20 opposite from the fixed jaw 14 on the frame 12. A handle 24 is mounted transversely in a sliding manner through a second side of the operating screw 20, so as to rotate the operating screw 20.

A structure 26 on the fixed jaw 14, is for maintaining the distance between the fixed jaw 14 and the sleeve 16, while increasing the length of the frame 12. This will keep the amount of manual turning the same when rotating the operating screw 20, to move the moveable jaw 22 towards and away from the fixed jaw 14 when clasping hard to reach articles 28 and 30 together.

The frame 12 includes an elongate base member 32. A first arm 34 extends at a right angle from a first side of the elongate base member 32. The sleeve 16 extends at a right angle form a distal end of the first arm 34 and is parallel with the elongate base member 32.

A second arm 36 extends at a right angle from a second side of the elongate base member 32. The fixed jaw 14 extends at a right angle from a distal end of the second arm 36, parallel with the elongate base member 32 and faces towards the sleeve 16.

The distance maintaining structure 26 is an extension piece 38 on the fixed jaw 14 parallel with the elongate base member 32 and faces towards the sleeve 16, which will increase the length of a throat 40 between the fixed jaw 14 and the sleeve 16. The moveable jaw 22 is a ball joint swivel head 42 on the first side of the operating screw 20.

The frame 12 is square shaped in cross section, with the elongate base member 32, the first arm 34, the sleeve 16, the second arm 36, the fixed jaw 14 and the extension piece 38 all having flat sides 44. The frame 12 can be placed in different positions upon a flat horizontal surface 46, such as lying down on its side in FIG. 3, standing longitudinally in FIG. 4 and standing latitudinally in FIG. 5.

The extension piece 38 is integral with the fixed jaw 14. The extension piece 38, contains a first bearing surface 48 directly opposite from the ball joint swivel head 42 of the moveable jaw 22.

The fixed jaw 14 includes an inner set back 50, so that the extension piece 38 will contain a second bearing surface 52 perpendicular with the first bearing surface 48 facing inwardly towards the elongate base member 32.

The fixed jaw 14 with the extension piece 38 is approximately one third the length of said elongate base member 32. The frame 12 with the extension piece 38 is fabricated out of a durable strong material 54. The durable strong material 54 can be metal, plastic or wood.

Figure 6:
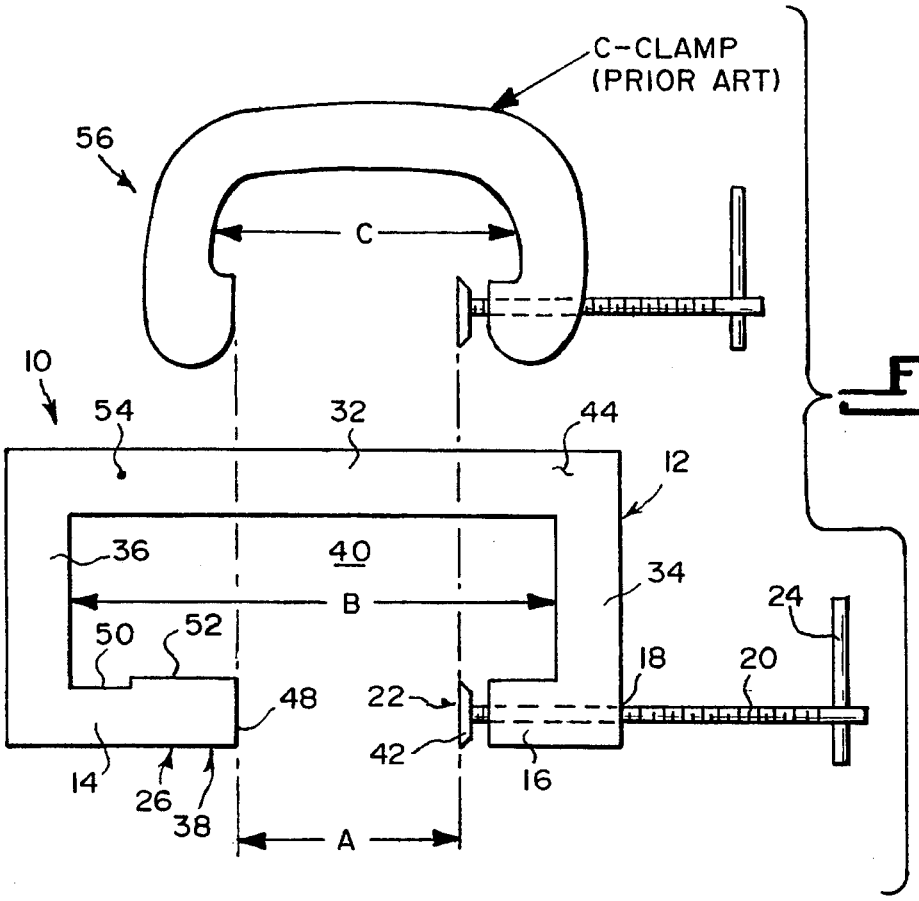
FIG. 6 is a diagrammatic plan view showing the jaw opening of the prior art, a C-clamp, being of the same distance as the instant invention, while the length of the throat of the prior art is shorter than the instant invention.

FIG. 6 shows the G-clamp 10 compared with the prior art being a C-clamp 56. The distance "A" being the jaw opening of the G-clamp 10 and the C-clamp 56 are of the same length. The throat length "B" of the G-clamp 10 is much larger than the throat length "C" of the C-clamp 56. The G-clamp 10 can be used for different difficult situations, such as when holding the hard to reach articles 28 and 30 together. The C-clamp 56 cannot do the job.

OPERATION OF THE INVENTION

To use the G-Clamp 10, the following steps should be taken:

1. Place the extension piece 38 of the fixed jaw 14 and the ball joint swivel head 42 of the moveable jaw 22 between the two articles 28 and 30.

2. Turn the handle 24 on the operating screw 20 in one direction, so that the moveable jaw 22 will move forward towards the extension piece 38, until the two articles 28 and 30 are clamped together between the first bearing surface 48 and the moveable jaw 22.

3. To release the G-Clamp 10, turn the handle 24 on the operating screw 20 in an opposite direction, so that the moveable jaw 22 will move away from the extension piece 38 in which the first bearing surface 48 will be released therefrom.

LIST OF REFERENCE NUMBERS

10 G-clamp
12 frame
14 fixed jaw
16 sleeve
18 internally threaded bore in 16
20 operating screw
22 moveable jaw on 20
24 handle on 20
26 distance maintaining structure
28 article
30 article
32 elongate base member
34 first arm
36 second arm
38 extension piece for 26
40 throat
42 ball joint swivel head for 22
44 flat side of 12
46 flat horizontal surface
48 first bearing surface on 38
50 inner set back
52 second bearing surface on 38
54 durable strong material for 12 and 38
56 C-clamp (prior art)

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A G-clamp comprising:

a) a frame having a fixed jaw at a first end, a sleeve with an internally threaded bore at a second end, an elongate base member, a first arm extending at a right angle from a first side of said elongate base member, said sleeve extending at a right angle from a distal end of arm and parallel with said elongate base member, a second arm extending at a right angle from a second side of said elongate base member and said fixed jaw located at the end of an extension piece extending at a right angle from a distal end of said second arm, parallel with said elongate base member and facing towards said sleeve and having a first bearing surface facing said sleeve.;

b) an operating screw extending through said internally threaded bore of said sleeve;

c) a moveable jaw comprising a ball joint swivel head mounted on a first side of said operating screw opposite from said fixed jaw on said frame;

d) a handle mounted transversely in a sliding manner through a second side of said operating screw, so as to rotate said operating screw;

e) an inner set back on said extension piece in the direction of said base member having a second bearing surface perpendicular to said first bearing surface facing said base member; and f) said frame being square shaped in cross section, with said elongate base member, said first arm, said sleeve, said second arm, said fixed jaw and said extension piece all having completely flat outer sides, thereby permitting said frame to stand or lay flat unsupported on a horizontal surface on any side other than the side where said operating screw extends outwardly from said frame.

* * * * *